US012181204B2

(12) United States Patent
Vijayan et al.

(10) Patent No.: US 12,181,204 B2
(45) Date of Patent: Dec. 31, 2024

(54) WIRELESS ANTI-CONDENSATION SYSTEM FOR A REFRIGERATOR APPLIANCE MULLION

(71) Applicant: Haier US Appliance Solutions, Inc., Wilmington, DE (US)

(72) Inventors: Vineeth Vijayan, Louisville, KY (US); Jordan Andrew Waymeyer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 156 days.

(21) Appl. No.: 17/950,289

(22) Filed: Sep. 22, 2022

(65) Prior Publication Data

US 2024/0102720 A1 Mar. 28, 2024

(51) Int. Cl.
*F25D 21/08* (2006.01)
*F28D 15/02* (2006.01)

(52) U.S. Cl.
CPC ..... *F25D 21/08* (2013.01); *F28D 15/02* (2013.01); *F28D 15/0275* (2013.01)

(58) Field of Classification Search
CPC ..... F25D 21/08; F28D 15/02
See application file for complete search history.

(56) References Cited

U.S. PATENT DOCUMENTS 1,992,011 A * 2/1935 Knight ..... F25D 21/04 62/DIG. 13
4,015,442 A * 4/1977 Schumacher ..... F25D 19/00 62/449
5,277,035 A * 1/1994 Fristoe ..... F25D 21/04 62/277
7,008,032 B2 * 3/2006 Chekal ..... F25D 23/02 49/316
8,250,873 B2 8/2012 Yoon et al.
10,480,849 B2 11/2019 Selin et al.
2007/0056711 A1 * 3/2007 Ohsawa ..... B23P 15/26 165/104.21
2008/0209812 A1 * 9/2008 Lancry ..... F25D 23/087 49/316
2009/0044556 A1 * 2/2009 Ihle ..... F25D 21/04 62/449
2010/0018235 A1 * 1/2010 Simoner ..... A47F 3/0434 62/265

(Continued)

FOREIGN PATENT DOCUMENTS

CN 109764606 A 5/2019
JP 2008008552 A * 1/2008

(Continued)

OTHER PUBLICATIONS

Translation of WO-2011003753A2 named Translation-WO2011003753A2 (Year: 2011).*

(Continued)

*Primary Examiner* — Paul Alvare
(74) *Attorney, Agent, or Firm* — Dority & Manning, P.A.

(57) ABSTRACT

A refrigerator appliance having a cabinet defining a chamber and a rotatably hinged door to at least partially seal the chamber or provide access to the chamber. The cabinet includes an induction coil and the door includes a heat pipe to provide a wireless anti-condensation system to a refrigerator mullion.

20 Claims, 6 Drawing Sheets

(56) References Cited

U.S. PATENT DOCUMENTS

| | | | | |
|---|---|---|---|---|
| 2013/0255931 | A1* | 10/2013 | Arnett | F28F 13/06 165/287 |
| 2014/0033756 | A1* | 2/2014 | Kuehl | F25D 23/065 62/272 |
| 2014/0033757 | A1* | 2/2014 | Kuehl | F25D 21/14 62/272 |
| 2017/0234606 | A1* | 8/2017 | Dubina | F25D 23/028 312/404 |
| 2018/0142942 | A1* | 5/2018 | Akalan | E06B 7/28 |
| 2019/0170427 | A1* | 6/2019 | Baum | F25D 23/02 |

FOREIGN PATENT DOCUMENTS

| | | | | |
|---|---|---|---|---|
| JP | 2018004214 | A * | 1/2018 | |
| WO | WO-2011003753 | A2 * | 1/2011 | F25D 21/04 |

OTHER PUBLICATIONS

Translation of JP-2008008552A named Translation-JP2008008552A (Year: 2008).*
Translation of JP-2018004214A named Translation-JP2018004214A (Year: 2018).*

* cited by examiner

WIRELESS ANTI-CONDENSATION SYSTEM FOR A REFRIGERATOR APPLIANCE MULLION

FIELD OF THE INVENTION

The present disclosure is related generally to refrigerator appliances and more particularly to a wireless system for reducing condensation on a mullion for a refrigerator appliance.

BACKGROUND OF THE INVENTION

Refrigerator appliances generally include a cabinet with one or more chilled compartments, e.g., a fresh food compartment, a freezer compartment, or the like, to maintain foods at low temperatures (i.e., lower than ambient). The chilled compartment(s) of a refrigerator are typically accessible through an opening, with access provided by one or more doors connected by hinges to the rest of the appliance.

Refrigerator appliances having two rotatably mounted opposing doors for access to a single opening, e.g., the fresh food compartment, are generally referred to as "French doors" refrigerators. French doors have desirable features, for example, lighter weight for each door and increased accessibility to the refrigerator cabinet.

However, French doors require additional sealing areas; in particular, the middle portion of the refrigerator opening where the two doors meet must maintain a seal when the doors are closed. Accordingly, some French door refrigerators include an articulating mullion rotatably attached via pivot points or hinges to one of the doors such that access to the compartment via the opening is not obstructed by the mullion when the door to which the articulating mullion is attached is opened. When closed, each of the doors sealingly engages the mullion with opposing edges of the doors spaced apart for clearance.

Some mullions for French door refrigerator appliances, and in particular articulated mullions, are at least partially formed of thermally conductive materials, such as e.g., metal. Thermally conductive materials are chosen because they typically have advantageous magnetic properties which can facilitate sealing of the doors with a magnetized sealing element when the doors of the refrigerator appliance are in a closed position. However, an inward facing portion of the thermally conductive material is in contact with the chilled air in the compartment and cools an exterior or front wall of the mullion that is in contact with relatively warm ambient air. When the warm ambient air contacts the cool front wall, the warm air is cooled and may cause condensation or "sweat" on the front wall depending on the humidity of the ambient air. The condensation is unsightly and may collect in areas that can cause a safety concern, such as development of mold or mildew, or affect the performance of the refrigerator appliance.

To prevent condensation, some articulating mullions include an electrically powered heating device within the mullion to remedy this undesirable effect. To provide electric power to these heating devices, electrically conductive wires are typically routed from the refrigerator cabinet to the door to which the articulating mullion is attached, and then to the heating element within the mullion. However, the design of some pivot points linking a door to a refrigerator appliance cabinet, or linking the mullion to the door make the routing of wires undesirable, impractical, or impossible.

Accordingly, a wireless system to reduce condensation on a mullion for a refrigerator appliance to address one or more of the above-described challenges would be beneficial.

BRIEF DESCRIPTION OF THE INVENTION

The present subject matter is directed to a refrigerator appliance having a cabinet, a pivotally attached door, and a mullion pivotally attached to the door that includes a system to reduce condensation on the mullion. In particular, the refrigerator appliance includes features to heat the mullion attached to the door without routing electrically conductive wires from the door to the mullion. Additional aspects and advantages of the invention will be set forth in part in the following description, or may be apparent from the description, or may be learned through practice of the invention.

In an exemplary aspect, a refrigerator appliance comprising a cabinet with first and second vertical walls, a top wall, and a bottom wall, an induction coil within a wall of the cabinet, a door rotatably hinged for rotation between a closed position and an open position, and an articulating mullion rotatably hinged to the door is disclosed. A heat pipe in positioned in the articulating mullion, wherein the heat pipe is operatively coupled to the induction coil when the door is in the closed position.

In another exemplary aspect, a refrigerator appliance comprising a cabinet with first and second vertical walls, a top wall, and a bottom wall, an induction coil within the top wall of the cabinet, a door rotatably hinged for rotation between a closed position and an open position, and an articulating mullion rotatably hinged to the door is disclosed. A heat pipe in positioned in the articulating mullion, the heat pipe including a wick, wherein the heat pipe is operatively coupled to the induction coil when the door is in the closed position.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
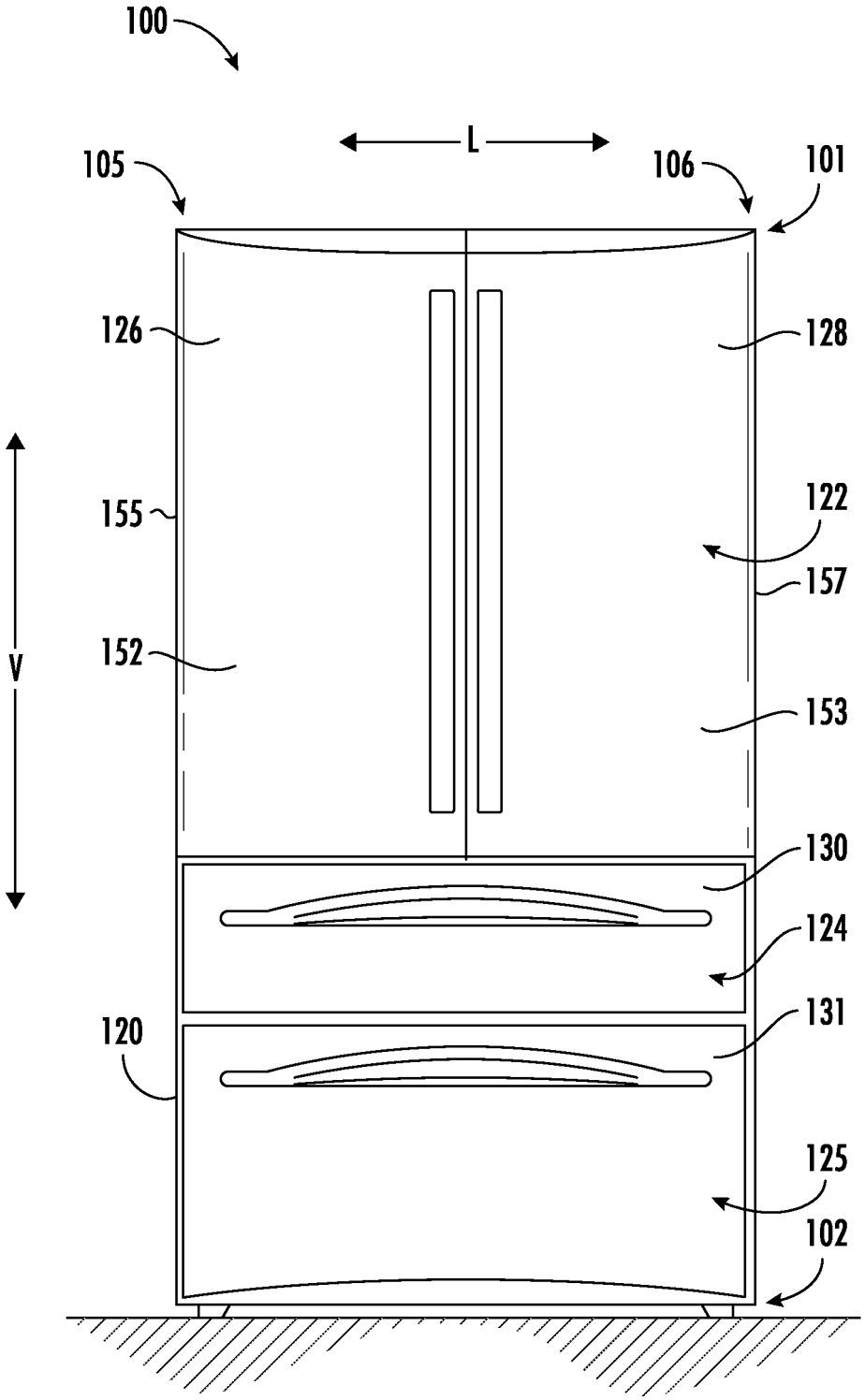
FIG. 1 provides a front view of a refrigerator appliance according to an exemplary embodiment of the present disclosure with refrigerator doors shown in a closed configuration.

Reference now will be made in detail to embodiments of the invention, one or more examples of which are illustrated in the drawings. Each example is provided by way of explanation of the invention, not a limitation of the invention. It will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Using the teachings disclosed herein, one of skill in the art will understand that the present technology can be used with other types of refrigerators (e.g., side-by-side) or a freezer appliance as well. Consequently, the description set forth herein is for illustrative purposes only and is not intended to limit the technology in any aspect.

For ease of illustration only, exemplary embodiments are shown on one door, the left door, of a French door refrigerator appliance. One of ordinary skill in the art will understand that the features described can be used on other doors, for example the right door of a French door refrigerator appliance, or on a drawer-type door to a refrigerator or freezer appliance.

As used herein, the terms "first," "second," "third," and "fourth" may be used to distinguish one component from another and are not intended to signify importance of the individual components. Terms such as "inner" and "outer" refer to relative directions with respect to the interior and exterior of the refrigerator appliance, and in particular the food storage chamber(s) defined therein. For example, "inner" or "inward" refers to the direction towards the interior of the refrigerator appliance. Terms such as "left," "right," "front," "back," "top," "bottom," "above," or "below" are used with reference to the perspective of a user accessing the refrigerator appliance. For example, a user stands in front of the refrigerator to open the doors and reaches into the food storage chamber(s) to access items therein.

As used herein, "substantially" means within ten degrees (10°) of the noted direction or within about ten percent (10%) of the noted value or within manufacturing tolerances, whichever margin is greater, unless specifically stated otherwise. Moreover, as used herein, where a wall of articulating mullion (e.g., front wall) is described as being formed of a particular material, the wall can be considered formed of the particular material even if another material is attached thereto, integrated or embedded into the wall, or coated or plated onto a surface of the wall.

FIG. 1 provides a front view of a refrigerator appliance 100 according to an exemplary embodiment of the present disclosure. Refrigerator appliance 100 extends between a top 101 and a bottom 102 along a vertical direction V. Refrigerator appliance 100 also extends between a first side 105 and a second side 106 along a lateral direction L. Further, refrigerator appliance 100 extends between a front and a back along a transverse direction T (FIG. 2), which is a direction orthogonal to the vertical direction V and the lateral direction L. Vertical direction V, lateral direction L, and transverse direction T are mutually perpendicular and form an orthogonal direction system.

Refrigerator appliance 100 includes a housing or cabinet 120 defining a fresh food chamber 122 (FIG. 2) and one or more freezer chambers, such as a first freezer chamber 124 and a second freezer chamber 125, which may both be arranged below fresh food chamber 122 along the vertical direction V. As illustrated, fresh food chamber 122 is bounded by a first vertical wall 108 at the first side 105 and a second vertical wall 110 at the second side 106, such walls spaced apart in the lateral direction, and horizontal top wall 140 (as a top side) at the top 101 and at the lower boundary by bottom wall 180 (as a bottom side), defining the lateral and vertical dimensions, respectively, of the chamber 122. In this configuration, refrigerator appliance 100 may generally be referred to as a bottom mount, or bottom freezer, refrigerator. Cabinet 120 also defines a mechanical compartment (not shown) for receipt of a sealed cooling system (not shown). It will be appreciated that the present subject matter can be used with other types of refrigerator appliances as well, such as e.g., top mount, or top freezer, refrigerator appliances. Consequently, the description set forth herein is not intended to limit the present subject matter in any aspect.

Figure 2:
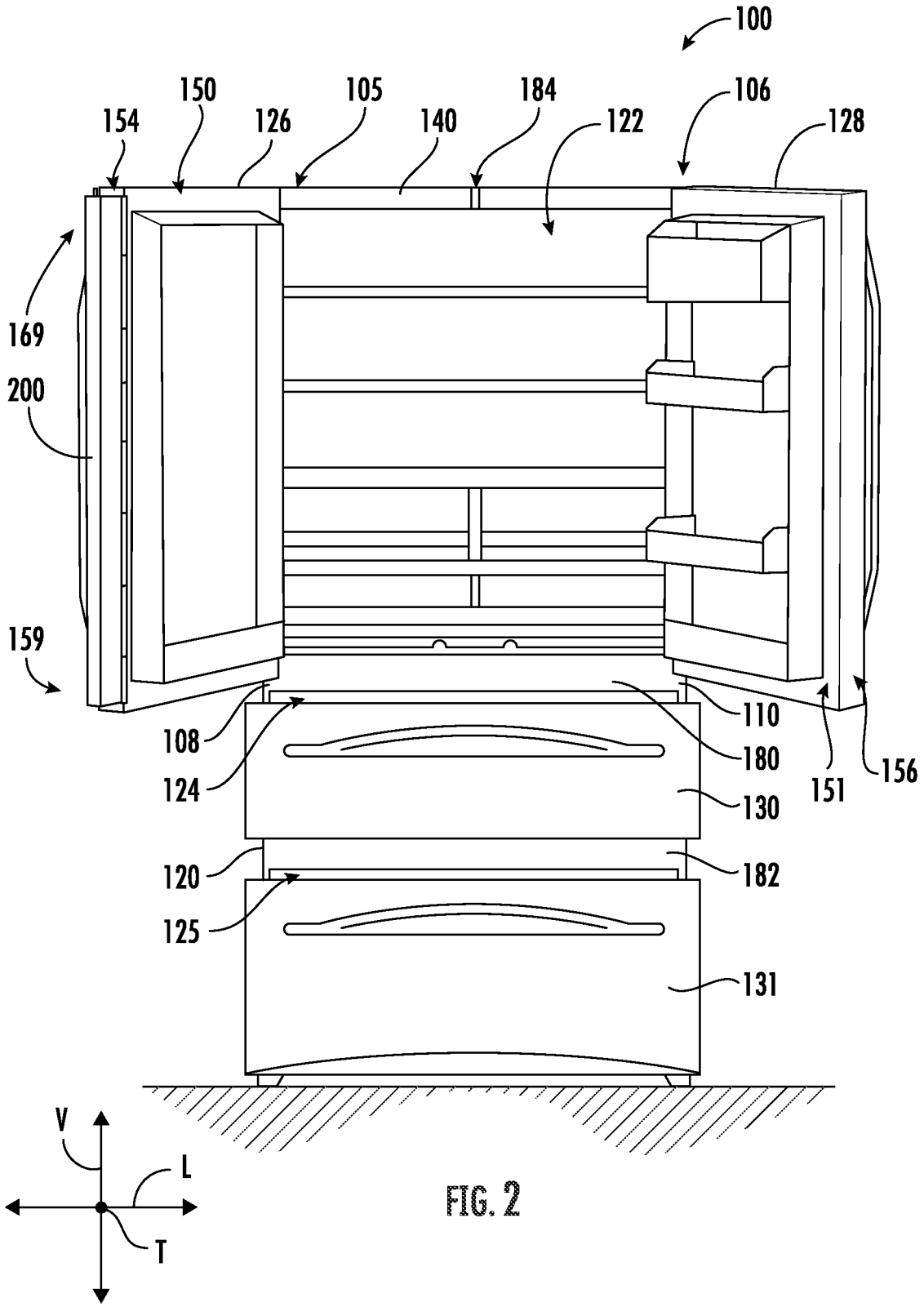
FIG. 2 provides a front view of the refrigerator appliance of FIG. 1 with refrigerator doors shown in an open configuration.

First and second refrigerator doors 126, 128, respectively, are rotatably hinged to an edge of cabinet 120 at first side 105 and second 106 side, between an open position providing access fresh food chamber 122 as illustrated in FIG. 2 or a closed position in which inner surfaces 150, 151 of the doors abut the first vertical wall 108 and second vertical wall 110 and the top wall 140 and bottom wall 180 of the cabinet, sealing fresh food chamber 122 as illustrated in FIG. 1. For example, upper and lower hinges may couple each door 126, 128 to cabinet 120. When first and second doors 126, 128 are configured as illustrated in FIGS. 1 and 2, the door arrangement is sometimes referred to as a "French door" configuration.

Freezer doors, such as a first freezer door 130 and a second freezer door 131, may be arranged below refrigerator doors 126, 128 for accessing one or more freezer chambers, such as first and second freezer chambers 124, 125, respectively. In the exemplary embodiment shown in FIG. 1, freezer doors 130, 131 are coupled to freezer drawers (not shown) slidably coupled within first and second freezer chambers 124, 125. Such drawers are thus generally "pull-out" drawers in that they can be manually moved into and out of freezer chambers 124, 125 on suitable slide mechanisms. Each door 126, 128, 130, 131 can include a handle for accessing one of the chambers 122, 124, 125 of refrigerator appliance 100.

FIG. 2 provides a front perspective view of refrigerator appliance 100 showing refrigerator doors 126, 128 in an open position to reveal the interior of fresh food chamber 122.

Door 126 of refrigerator appliance 100 includes an inner surface 150 and an outer surface 152 (FIG. 1). Inner surface 150 generally defines a portion of the interior of fresh food chamber 122 when door 126 is in a closed position as shown in FIG. 1. Outer surface 152 is generally opposite inner surface 150 and defines a portion of the exterior of refrigerator appliance 100 when door 126 is in the closed position. Door 126 includes first side surface 154 and second side surface 155 extending between and connecting inner surface 150 and outer surface 152. As illustrated for example in FIG. 3, the intersection of first inner surface 150 and first side surface 154 form edge 158. The same construction may result in similarly formed edges at the other intersections of side surfaces 155, 156, 157 and inner surface 151 and outer surfaces 152, 153. It will be appreciated that door 128 can be configured in the same or similar manner as door 126 with inner surface 151, outer surface 153 and third and fourth side surfaces 156, 157, respectively, extending between and connecting inner surface 151 and outer surface 153. Moreover, it will further be appreciated that freezer doors 130, 131 can likewise include inner, outer, and side surfaces.

As further shown in FIG. 2, refrigerator appliance 100 includes various mullions to generally divide the various chambers of refrigerator appliance 100 and/or prevent leakage therefrom. In the present embodiment of a French door refrigerator, refrigerator appliance 100 includes an articulating mullion 200 disposed on first door 126 and a bottom wall 180 disposed between and separating fresh food chamber 122 and first freezer chamber 124. Refrigerator appliance 100 also includes a stationary mullion 182 disposed between and separating first freezer chamber 124 and second freezer chamber 125. Bottom wall 180 and stationary mullion 182 generally extend along the lateral direction L between first end 105 and second end 106 of refrigerator appliance 100 and generally extend along the vertical direction V to separate the various chambers of refrigerator appliance 100. Moreover, although not shown in FIG. 2, bottom wall 180 and stationary mullion 182 generally extend along the transverse direction T approximately the depth of refrigerator appliance 100.

Figure 3:
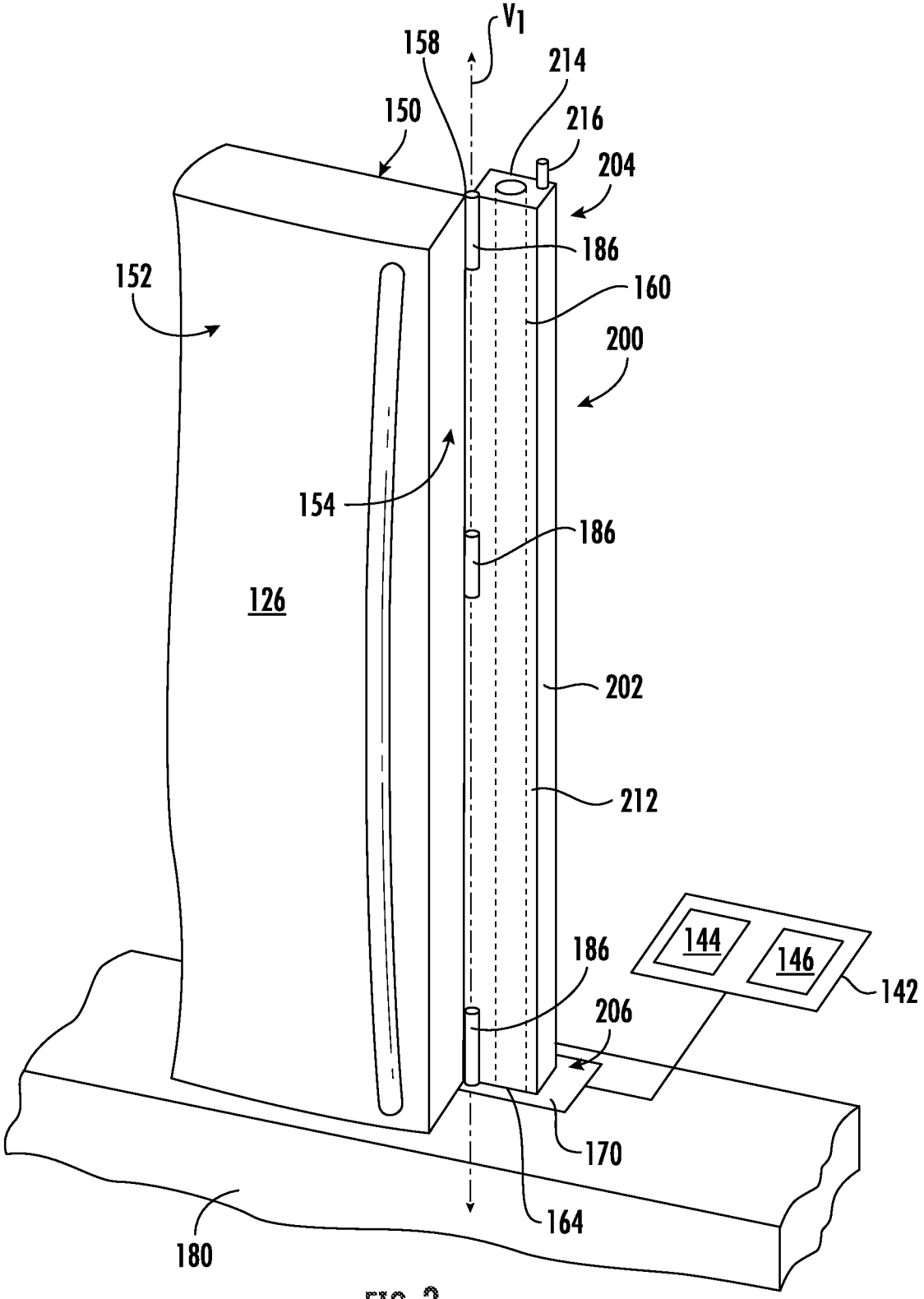
FIG. 3 provides a perspective view of a door and an articulating mullion connected to the door of the refrigerator appliance of FIG. 1.

Refrigerator appliance 100 includes an elongate articulating mullion 200 rotatably coupled or connected to door 126 and positioned so that the long axis of the mullion 200 is parallel to the vertical direction V as shown in FIGS. 2 and 3. In other embodiments, articulating mullion 200 can be connected to door 128. In yet other embodiments, articulating mullion 200 can be connected to any suitable door of refrigerator appliance 100. Moreover, refrigerator appliance 100 can include any suitable number of articulating mullions 200. For example, where refrigerator appliance 100 has a quad door configuration (i.e., having two rotatably mounted "French door" fresh food doors and two rotatably mounted "French door" freezer doors positioned below the fresh food doors), refrigerator appliance 100 can include one articulating mullion 200 connected to one of the freezer doors and one articulating mullion connected to one of the fresh food doors.

Referring now to FIG. 3, provided is a perspective view of an exemplary first door 126, bottom wall 180, and articulating mullion 200 connected to door 126 of exemplary refrigerator appliance 100 of FIGS. 1 and 2. As illustrated, articulating mullion 200 can be rotatably coupled or rotatably hinged, via hinges 186, to door 126. Articulating mullion 200 can be rotated or articulated about a vertical axis Vi, which extends along the vertical direction V through hinges 186 as shown.

In an exemplary embodiment of the present application, the refrigerator appliance 100 includes an induction coil within the bottom wall 180. For example, according to an embodiment of this disclosure illustrated in FIG. 3, bottom wall 180 includes an induction coil 170. The induction coil 170 (represented schematically) is positioned within the bottom wall 180 such that, when the door 126 is in the closed position of FIG. 3 for example, the induction coil 170 is vertically aligned with the mullion 200. As generally understood, an induction coil is an electrical device that creates high voltage pulses and a rapidly alternating magnetic field. An electrical control circuit 142 within the cabinet 120 includes circuitry 144 (including power supplies, switches, timers, circuit interrupters, temperature sensors, humidity sensors, and the like) necessary to selectively provide electrical power to the induction coil 170. The control circuit may include a door position sensor 146 to provide power to the induction coil 170 only when the door 126 is in certain positions, for example in the closed position as illustrated in FIGS. 1 and 3. In some embodiments, the temperature and humidity sensors detect the temperature and humidity of the ambient air 192 (FIG. 7) and provide power to the induction coil 170 when the door 126 is closed and certain temperature and humidity conditions are detected. For example, when detected temperature and humidity predict a risk of condensation on mullion 200 and the door 126 is closed, circuitry 144 provides power to the induction coil 170. When provided with power, induction coil 170 creates a rapidly alternating magnetic field. When an electrical conductor, particularly a conductor comprising a ferrous material, is placed within the magnetic field generated by the induction coil 170, the conductor and the induction coil may be said to be operatively coupled, and the magnetic field creates eddy currents within the electrical conductor. The eddy currents flow through the electrical conductor against the electrical resistance of the metallic conductor and heat the conductor through Joule heating.

In the exemplary embodiment of FIG. 3, mullion 200 includes heat pipe 160 extending between the top portion 204 and the bottom portion 206 of mullion 200. As generally understood, a heat pipe is a sealed tube containing a working fluid, or refrigerant. One end of the tube is configured to absorb heat and transfer the heat to the refrigerant, vaporizing the refrigerant. The vaporized refrigerant travels along a length of the tube to a lower temperature area where it condenses back to a liquid state, transferring its latent heat to the cooler portion of the tube. The portion of the heat pipe that absorbs heat may be referred to as the evaporator portion or end and the portion of the heat pipe that transfers, or gives up, heat may be referred to as the condenser portion or end.

Figure 4:
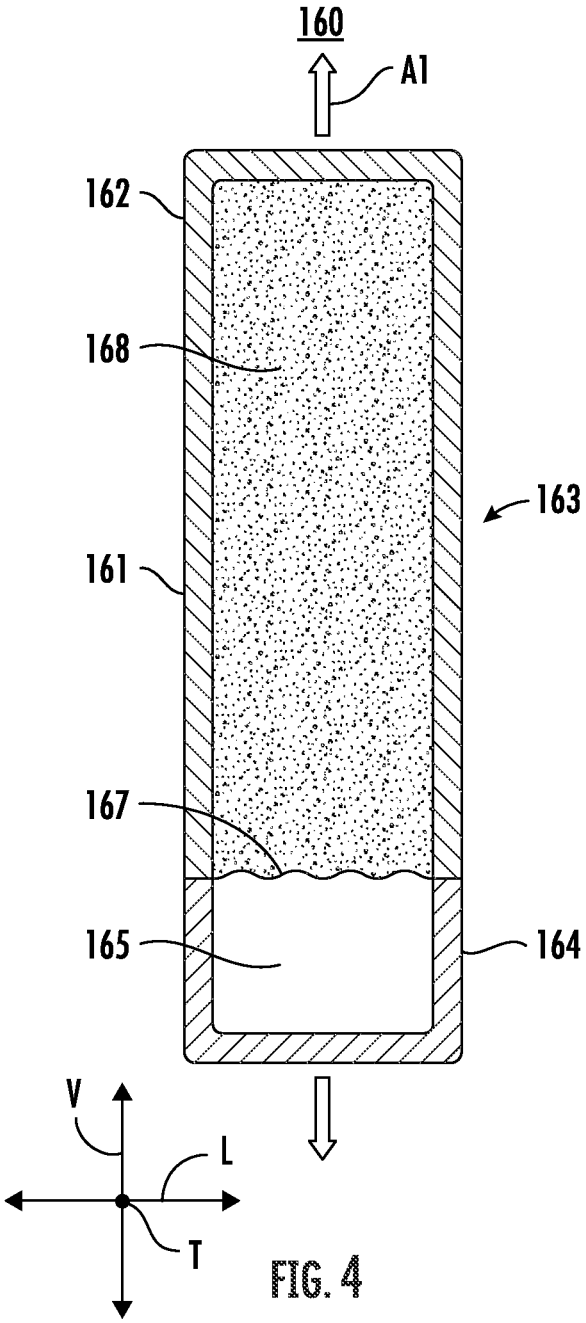
FIG. 4 provides a vertical cross-sectional view of a heat pipe in accordance with an embodiment of the present disclosure.

As illustrated in FIG. 3, and in more detail in FIG. 4, exemplary heat pipe 160 comprises a sealed, elongate hollow tube 161, generally cylindrical in shape for ease of illustration, having a first end 162, a second end 164, and a body 163 between the first and second ends 162, 164. The heat pipe 160 is generally formed from one or more thermally and electrically conductive materials, for example one or more metals. In an embodiment, the first end 162 and the body 163 are formed from a first thermally and electrically conductive material, for example a material comprising copper. The second end 164 may be formed from the same first thermally and electrically conductive material, or the same first thermally and electrically conductive material coated or plated with a ferrous material, or may be made from a second thermally and electrically conductive material comprising a ferrous material and sealingly attached to the body 163, for example using a metal joining process, such as brazing or soldering, or using mechanical means of attachment such as crimping, a threaded connection, or interference fit.

As illustrated in FIG. 4, an amount of working fluid or refrigerant 165 is contained within the sealed hollow tube 161. Refrigerant 165 is illustrated as a liquid collected at the second end 164 of the heat pipe 160. Depending on the temperature of the heat pipe 160, a portion of the refrigerant 165 may be present as a refrigerant vapor 168 filling the tube above the surface 167 of the liquid portion of refrigerant 165.

In the exemplary embodiment of FIG. 3, the long axis A1 of the heat pipe 160 is positioned generally parallel to the vertical axis Vi with the second end 164 positioned below the first end 162. When heat pipe 160 is positioned within the articulating mullion 200 as in FIG. 3, the second end 164 is proximate to the induction coil 170. In this configuration, the second end 164 is acting as a conductor as described above, placed within a magnetic field generated by the induction coil 170, operatively coupling the second end 164 and the induction coil 170. The magnetic field produced by the induction coil 170 induces eddy currents in the second end 164, heating the second end 164 by Joule heating. The second end can therefore be considered the evaporator portion (or end) of the heat pipe 160. The distance or spacing between the second end 164 and the induction coil 170 when door 126 is closed is preferably between 0.0 inch (0.0 mm) and 0.5 inch (12.7 mm), more preferably between 0.13 inch (3.3 mm) and 0.38 inch (9.7 mm), more preferably still, the separation is 0.25 inch (6.4 mm).

The first end 162, positioned vertically above the second end 164 can be considered the condenser portion (or end). In such an orientation, with the condenser portion vertically above the evaporator portion, the heat pipe 160 is sometimes referred to as a thermosyphon. As generally understood, a thermosyphon is a heat exchange device, a specific type of heat pipe, that operates based on the natural convection of the working fluid or refrigerant. The liquid portion of refrigerant 165 collects at the vertically lower second end 164 of the heat pipe 160. The induction coil 170 heats the second end 164 (in this configuration the evaporator end) as described above, which in turn heats the refrigerant 165, vaporizing at least a portion of the refrigerant 165, creating a refrigerant vapor 168. The refrigerant vapor 168 naturally rises, flowing along the body 163 towards the first end 162, giving up its latent heat as it flows. Beneficially, as the refrigerant vapor 168 travels upward from second end 164 towards first end 162, the latent heat is transferred to body 163, increasing the temperature of the body 163. Relatively warm body 163 transfers heat to the mullion 200, in particular to the front face 212. As the refrigerant vapor 168 cools as it flows upward along the length of the body 163, a portion condenses to a liquid stage, and flows under the force of gravity back to the second end 164 to repeat the cycle.

Figure 5:
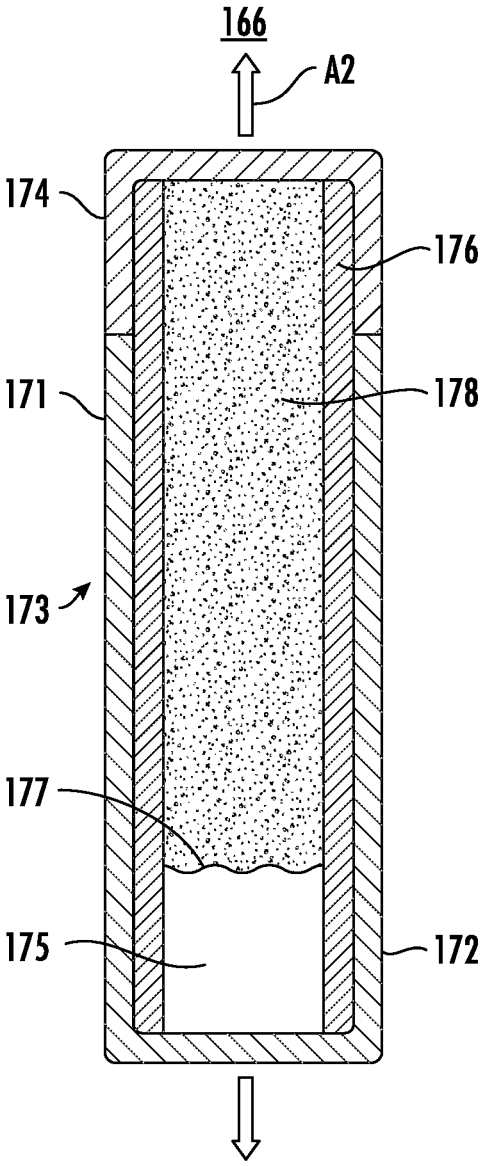
FIG. 5 provides a vertical cross-sectional view of a heat pipe in accordance with an embodiment of the present disclosure.
Figure 6:
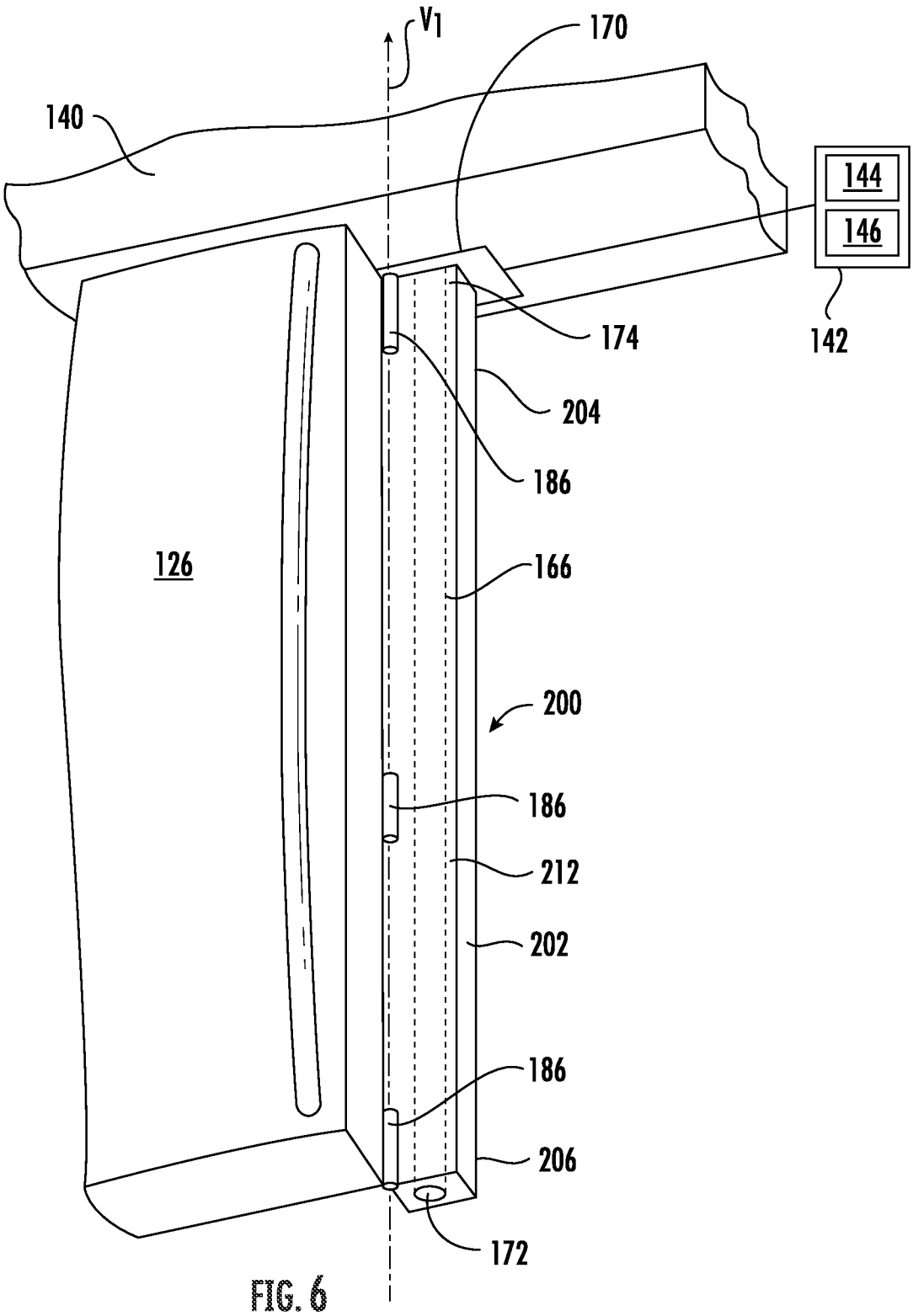
FIG. 6 provides a perspective view of a door and an articulating mullion connected to the door of the refrigerator appliance of FIG. 1.

FIG. 5 represents an exemplary heat pipe in accordance with an embodiment of the present disclosure. The exemplary heat pipe 166 is of similar construction as heat pipe 160 in that heat pipe 166 is generally a sealed, elongate hollow tube 171 having a body 173, a first end 172 (the condenser end), and a second end 174 (the evaporator end). The heat pipe 166 is illustrated as a generally cylindrical shape for ease of illustration. In the present embodiment illustrated in FIG. 5, the orientation of heat pipe 166 is inverted from that of heat pipe 160 (FIG. 4), so the first end 172 is vertically lower that the second end 174 when in use (FIG. 6). The heat pipe 166 is generally formed from one or more thermally and electrically conductive materials, for example one or more metals. In an embodiment, the first end 172 and the body 173 are formed from a first thermally and electrically conductive material, for example a material comprising copper. The second end 174 may be formed from the same first thermally and electrically conductive material, or the same first thermally and electrically conductive material coated or plated with a ferrous material, or may be made from a second thermally and electrically conductive material comprising a ferrous material and sealingly attached to the body 173, for example using a metal joining process such as brazing or soldering, or using mechanical means of attachment such as crimping, a threaded connection, or interference fit.

As illustrated in FIG. 5, an amount of working fluid or refrigerant 175 is contained within the sealed tube 171. Refrigerant 175 is illustrated in a liquid state collected at the first end 172 (condenser end) of the heat pipe 166. Depending on the temperature of the heat pipe 166, a portion of the refrigerant 175 may be present as a refrigerant vapor 178 filling the tube above the surface 177 of the liquid portion of refrigerant 175.

Embodiments of heat pipe 166 may also include a wick 176 in the interior hollow space of body 173. The wick 176 may be a lining or coating on a portion of the inside surface of the body 173, or may be an insert or strip of material, extending from the sealed first end 172 (condenser end) to the sealed second end 174 (evaporator end). The material and construction for wick 176 are selected to facilitate the transport, via capillary action, of a portion of the liquid state refrigerant 175 from the first end 172 to the second end 174.

Referring now to FIG. 6, provided is a perspective view of an exemplary first door 126, top wall 140, and articulating mullion 200 connected to door 126 of exemplary refrigerator appliance 100 of FIGS. 1 and 2. As illustrated, articulating mullion 200 can be rotatably coupled or rotatably hinged, via hinges 186, to door 126. Articulating mullion 200 can be rotated or articulated about a vertical axis Vi, which extends along the vertical direction V through hinges 186 as shown.

According to an embodiment of this disclosure illustrated in FIG. 6, top wall 140 includes an induction coil 170. The induction coil 170 (represented schematically) is positioned within the top wall 140 such that, when the door 126 is in the closed position of FIG. 6 for example, the induction coil 170 is vertically aligned with the mullion 200. The induction coil 170 functions generally as discussed above, and is provided with electrical power via an electrical control circuit 142 within cabinet 120. As described above, the electrical control circuit 142 may include circuitry 144 (including power supplies, switches, timers, circuit interrupters, temperature sensors, humidity sensors, and the like) to selectively provide electrical power to the induction coil 170, and may include a door position sensor 146 to provide power to the induction coil 170 only when the door 126 is in certain positions, for example when the door 126 is in the closed position as in FIGS. 1 and 5. In some embodiments, the temperature and humidity sensors detect the temperature and humidity of the ambient air 192 (FIG. 7) and provide power to the induction coil 170 when the door 126 is closed and certain temperature and humidity conditions are detected. For example, when detected temperature and humidity predict a risk of condensation on mullion 200 and the door 126 is closed, circuitry 144 provides power to the induction coil 170.

As discussed above, when provided with power, induction coil 170 creates a rapidly alternating magnetic field. When a metal conductor, particularly a conductor comprising a ferrous material, is placed within the magnetic field generated by the induction coil 170, the conductor and the induction coil 170 are said to be operatively coupled, and the magnetic field creates eddy currents within the conductor. The eddy currents flow through the conductor against the electrical resistance of the metallic conductor and heat the conductor through Joule heating.

In the exemplary embodiment of FIG. 6, mullion 200 includes heat pipe 166 extending between the top portion 204 and the bottom portion 206 of mullion 200. As generally discussed above, a heat pipe is a sealed tube containing a working fluid, or refrigerant. One end of the tube is configured to absorb heat and transfer the heat to the refrigerant, vaporizing the refrigerant. The vaporized refrigerant travels along a length of the tube to a lower temperature area where it condenses back to a liquid state, transferring its latent heat to the cooler portion of the tube. The portion of the heat pipe that absorbs heat may be referred to as the evaporator portion or end and the portion of the heat pipe that transfers, or gives up, heat may be referred to as the condenser portion or end.

In the embodiment illustrated in FIG. 6, the long axis A2 of heat pipe 166 is positioned generally parallel to the vertical axis Vi with the second end 174 positioned vertically above the first end 172. When heat pipe 166 is positioned within the articulating mullion 200 as in FIG. 6, the second end 174 is proximate to the induction coil 170. As discussed above, the second end 174 is an electrical conductor placed within the magnetic field generated by the induction coil 170, operatively coupling the second end 174 and the induction coil 170. The magnetic field creates eddy currents in the second end 174, elevating the temperature of the second end through Joule heating. Second end 174 can therefore be considered the evaporator portion (or end) of the heat pipe 166. The first end 172, positioned vertically below the second end 174 can be considered the condenser portion (or end). The spacing between the second end 174 and the induction coil 170 when the door 126 is closed is preferably between 0.0 inch (0.0 mm) and 0.5 inch (12.7 mm), more preferably between 0.13 inch (3.3 mm) and 0.38 inch (9.7 mm), more preferably still, the separation is 0.25 inch (6.4 mm).

Configured as illustrated in FIG. 5, wick 176 facilitates the transport of refrigerant 175 in the liquid state from the first end 172 of heat pipe 166 to the second end 174. The transport is accomplished without external forces, and in opposition to gravity, through the principle of capillary action. The capillary action may be beneficially impacted by selecting the material and construction of wick 176 based on the fluid characteristics of the refrigerant 175.

As the wick 176 transports the refrigerant 175 to the second end 174, induction heater 170 heats the second end 174 of heat pipe 166 through Joule heating as described above. Some of the heated refrigerant vaporizes to form a refrigerant vapor 178. With the continuous capillary flow of refrigerant 175 in wick 176, newly-formed refrigerant vapor 178 displaces existing vapor in a vertically downward direction. As the refrigerant vapor 178 contacts the relatively cooler inside surface of body 173, a portion of the vapor gives up its latent heat to the body 173 and condenses. The condensed refrigerant flows vertically downward under the force of gravity and returns to refrigerant 175 in liquid form at first end 172 of the heat pipe 166 to repeat the cycle.

Beneficially, as the refrigerant vapor 178 travels downward from second end 174 towards first end 172, the latent heat of the refrigerant is transferred to body 173, increasing the temperature of the body 173. Relatively warm body 173 transfers heat to the mullion 200, in particular to the front wall 220 (FIG. 7).

Figure 7:
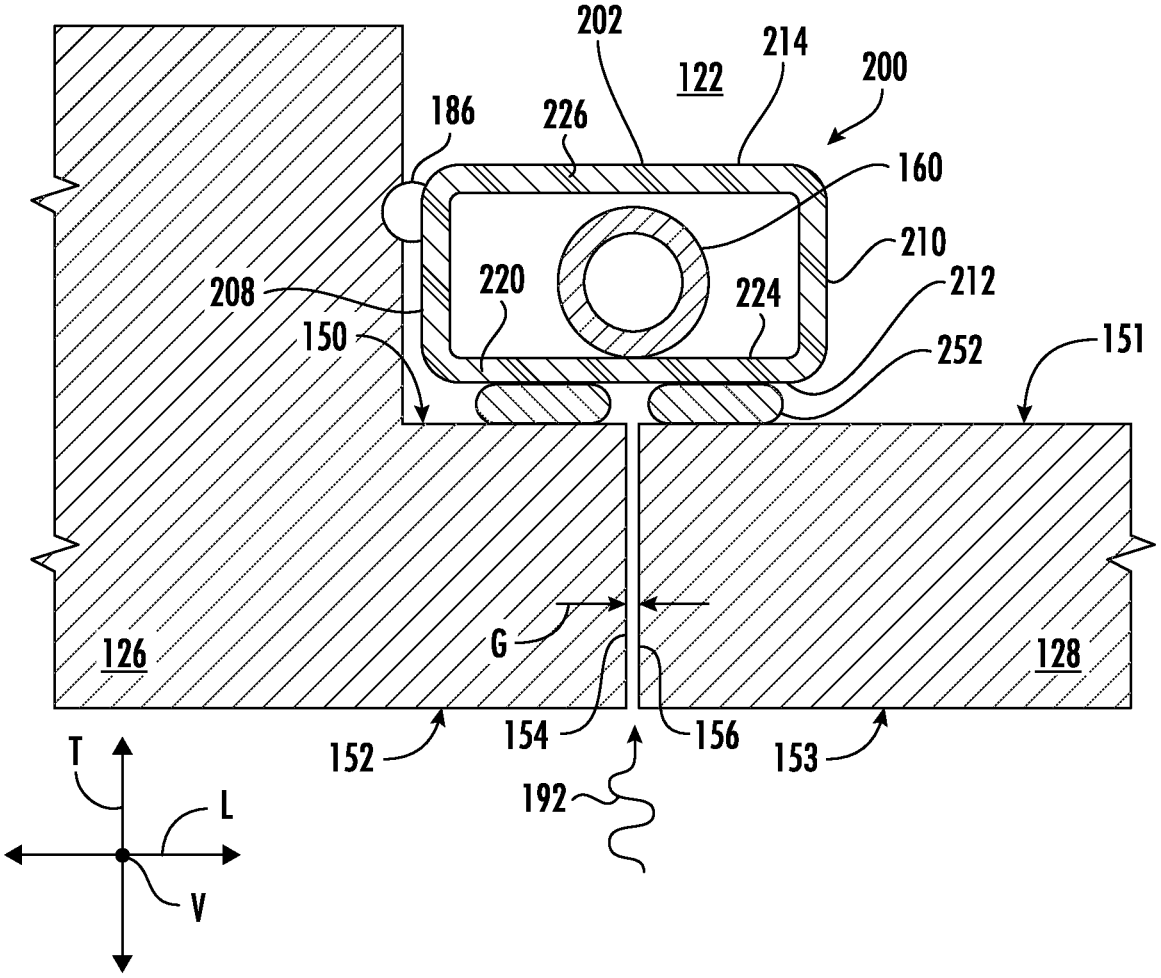
FIG. 7 provides a cross-sectional view of doors of an exemplary refrigerator appliance in a closed position and contacting an exemplary articulating mullion according to an exemplary embodiment of the present disclosure.

FIG. 7 represents a cross-sectional view of a portion of the refrigerator appliance 100 taken with doors 126, 128 in the closed position of FIG. 1 at the point where side surface 154 and side surface 156 abut in a substantially parallel orientation. The cross-sectional view of the mullion 200 is representative of the illustrative embodiments of both FIG. 3 and FIG. 6. Recognizing that the representation will be the same, for ease of illustration, the embodiment of FIG. 3 will be used with the understanding that any reference to heat pipe 160 also pertains to heat pipe 166 as it applies to FIG. 7.

As shown in the illustrative embodiment of FIG. 7, articulating mullion 200 includes a body 202 which is shown as generally hollow and rectangular in cross-sectional shape for ease of illustration. It will be appreciated that body 202 can have any suitable cross-sectional shape as will be apparent to an ordinarily skilled artisan. Body 202 extends between a top portion 204 and a bottom portion 206 along the vertical direction V (FIG. 3), between a first end 208 and a second end 210 along the lateral direction L, and between a front face 212 and a rear face 214 along the transverse direction T.

Heat pipe 160 may be located within the body 202 and may advantageously be in contact with rear face 224 of front wall 220 of mullion 200. As described above, when refrigerant vapor 168 flows within the body 163 of heat pipe 160, heat is transferred to the body 163, and then to the front face 220 of the mullion 200. As would be obvious to a normally skilled artisan, the heat transfer may be facilitated if the body 163 is in contact with the front face 220. Heat transfer from the heat pipe 160 to the front wall 220 may be facilitated by forming a portion of the front wall 220 from a thermally conductive material, for example a metal.

For ease of illustration, body 202 is shown as generally hollow. In some embodiments, body 202 may be filled with an insulating material, for example polyurethane or expanded polystyrene.

Articulating mullion 200 includes a tab 216 extending from body 202 as shown in FIG. 3. For this exemplary embodiment, tab 216 extends from top portion 204 of body 202 for ease of illustration. In some embodiments, tab 216 can extend from bottom portion 206 of body 202. In yet other embodiments, body 202 can include tabs 216 extending from both top portion 204 and bottom portion 206. In illustrative embodiments, the tab 216 may comprise a portion of the heat pipe 160 (or 166) extending from the top portion 204, the bottom portion 206, or both the top and bottom portions 204, 206 of body 202.

Tab 216 may be sized and shaped to fit within and interact with a groove 184 defined in cabinet 120 of refrigerator appliance 100 (FIG. 2). The groove 184 may be formed in top wall 140 (as illustrated), bottom wall 180 (not shown), or both top wall and bottom wall 140, 180. For example, groove 184 may include cam surfaces that may interact with tab 216 to cause rotation of articulating mullion 200 from a first position to a second position when door 126 is rotated from a closed position (FIGS. 1 and 3) to an open position (FIG. 2) or vice versa. In embodiments in which the tab 216 comprises a portion of the heat pipe 160 (or 166) extending from top portion 204 or bottom portion 206, or both top and bottom portions 204, 206, induction coil 170 may be integrated with a groove 184. For example, a portion of the heat pipe 160 may extend from top portion 204, or bottom portion 206, of the mullion body 202 and extend into the tab 216 (the tab 216 may comprise that portion of the heat pipe that extends beyond the mullion body 202). The groove 184 may be formed in the top wall 140 or bottom wall 180 to accept the tab 216 extending from top portion 204 or bottom portion 206 as appropriate. The induction coil 170 may be located vertically below the groove 184, or transversely behind the groove 184, or the induction coil 170 may be integrated with the groove 184 in either the top wall 140 or bottom wall 180 such that the tab 216 is concentric with a portion of the induction coil 170. In such configurations, when door 126 is in the closed position (FIG. 1) the tab 216, and consequently the extending portion of the heat pipe, can be within the preferable range of spacing to the induction coil 170 as discussed above.

As shown in FIG. 7, body 202 includes a front wall 220 having a front face 212 and a rear face 224 opposite front face 212. When door 126 is in the closed position of FIGS. 3 and 6, or when both door 126 and door 128 are in the closed position of FIG. 7, front wall 220 is oriented in a plane parallel to the vertical and lateral directions V, L. Likewise, front face 212 of front wall 220 is coplanar with the vertical and lateral direction V, L. Front face 212 of front wall 220 faces the exterior of refrigerator appliance 100 and rear face 214 of rear wall 226 faces the interior of refrigerator appliance 100 when door 126 is in a closed position.

As shown in FIG. 7, when doors 126, 128 are in a closed position, a gap G is defined between doors 126, 128. Ambient air 192, which is generally warm relative to the cooled or chilled air of fresh food chamber 122 (or similarly first or second freezer chambers 124, 125) of refrigerator appliance 100, flows through gap G and contacts front face 212 of front wall 220 of articulating mullion 200. As articulating mullion 200 is positioned to block the airflow through gap G, articulating mullion 200 prevents relatively warm ambient air 192 from leaking into refrigerator appliance 100. Articulating mullion 200 also prevents cooled or chilled air from flowing out of refrigerator appliance 100. To prevent such leakage, first and second inner surfaces 150, 151 of each door 126, 128, respectively, or one or more gaskets 252 along such inner surfaces 150, 151, contact front face 212 of articulating mullion 200. To hermetically seal front face 212 with doors 126, 128, each door 126, 128, or gaskets 252, and articulating mullion 200 can include magnets or comprise materials having magnetic properties to seal doors 126, 128 in sealing engagement with articulating mullion 200.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance defining a vertical direction, a lateral direction, and a transverse direction, the vertical, lateral, and transverse directions being mutually perpendicular, the refrigerator appliance comprising:

a cabinet comprising:

a first vertical wall and a second vertical wall spaced laterally from the first vertical wall;

a bottom wall and a top wall spaced vertically above the bottom wall, the first and second vertical walls and the bottom and top walls defining a lateral and a vertical dimension of a chamber; and a groove formed in the bottom wall, the groove comprising cam surfaces;

an induction coil within the bottom wall of the cabinet;

a door rotatably hinged to the cabinet and supported for rotation between a closed position in which an inner surface of the door abuts at least one of the first and second vertical walls and the bottom and top walls to seal a portion of the chamber, and an open position providing access to a portion of the chamber;

an articulating mullion rotatably hinged to the door; and a heat pipe extending between a sealed first end and a sealed second end, the heat pipe positioned within the articulating mullion, wherein the induction coil is positioned such that the second sealed end of the heat pipe is adjacent to the induction coil when the door is in the closed position, wherein the cam surfaces interact with a tab extending from a bottom portion of the mullion, wherein the tab comprises the sealed second end of the heat pipe and the induction coil is integrated with the groove, and wherein the heat pipe is operatively coupled to the induction coil when the door is in the closed position.

2. The refrigerator appliance of claim 1, the heat pipe further comprising:

an elongate hollow tube having the sealed first end and the sealed second end, the elongate hollow tube defining a heat pipe axis;

wherein the heat pipe axis is substantially parallel to a vertical axis of the mullion, the sealed first end proximate to a top portion of the mullion and the sealed second end proximate to a bottom portion of the mullion.

3. The refrigerator appliance of claim 2, wherein the hollow tube is formed from one or more thermally conductive materials.

4. The refrigerator appliance of claim 3 wherein the hollow tube comprises copper.

5. The refrigerator appliance of claim 3 wherein a portion of at least one of the sealed first end and the sealed second end comprises a ferrous material.

6. The refrigerator appliance of claim 2, the heat pipe further comprising a refrigerant contained within the hollow tube.

7. The refrigerator appliance of claim 6, wherein the heat pipe is a thermosyphon.

8. The refrigerator appliance of claim 2, wherein the first end of the heat pipe is a condenser and the second end is an evaporator.

9. The refrigerator appliance of claim 2 wherein the induction coil is selectively powered through an electrical control circuit within the cabinet.

10. The refrigerator appliance of claim 9 wherein the electrical control circuit comprises a door position sensor to determine when the door is in the closed position.

11. The refrigerator appliance of claim 9 wherein the induction coil is powered when the door is in the closed position.

12. A refrigerator appliance defining a vertical direction, a lateral direction, and a transverse direction, the vertical, lateral, and transverse directions being mutually perpendicular, the refrigerator appliance comprising:

a cabinet comprising:

a first vertical wall and a second vertical wall spaced laterally from the first vertical wall;

a bottom wall and a top wall spaced vertically above the bottom wall, the first and second vertical walls and the bottom and top walls defining a vertical and a lateral dimension of a chamber; and a groove formed in the top wall, the groove comprising cam surfaces;

an induction coil within the top wall of the cabinet;

a door rotatably hinged to the cabinet and supported for rotation between a closed position in which an inner surface of the door abuts the bottom and top walls and at least one of the first and second vertical walls to seal a portion of the chamber, and an open position providing access to a portion of the chamber;

an articulating mullion rotatably hinged to the door; and a heat pipe extending between a sealed first end and a sealed second end, the heat pipe positioned within the articulating mullion, the heat pipe including a wick, wherein the induction coil is positioned such that an end of the heat pipe is adjacent to the induction coil when the door is in the closed position, wherein the cam surfaces interact with a tab extending from a top portion of the mullion, wherein the tab comprises the sealed second end of the heat pipe and the induction coil is integrated with the groove, and wherein the heat pipe is operatively coupled to the induction coil when the door is in the closed position.

13. The refrigerator appliance of claim 12, the heat pipe further comprising:

an elongate hollow tube having the sealed first end and the sealed second end, the elongate hollow tube defining a heat pipe axis; and a refrigerant;

wherein the heat pipe axis is substantially parallel to a vertical axis of the mullion, the sealed second end proximate to a top portion of the mullion, the sealed first end proximate to a bottom portion of the mullion, and the wick extending between the first end and the second end.

14. The refrigerator appliance of claim 13, wherein the hollow tube is formed from one or more thermally conductive materials.

15. The refrigerator appliance of claim 14, wherein a portion of the sealed second end comprises a ferrous material.

16. The refrigerator appliance of claim 13 wherein the first end is a condenser end and the second end is an evaporator end.

17. The refrigerator appliance of claim 16, wherein the wick is configured to transport the liquid state refrigerant from the first end to the second end.

18. A refrigerator appliance defining a vertical direction, a lateral direction, and a transverse direction, the vertical, lateral, and transverse directions being mutually perpendicular, the refrigerator appliance comprising:

a cabinet comprising:

a first vertical wall and a second vertical wall spaced laterally from the first vertical wall;

a bottom wall and a top wall spaced vertically above the bottom wall, the first and second vertical walls and the bottom and top walls defining a vertical and a lateral dimension of a chamber; and a groove formed in one of the top wall or the bottom wall, the groove comprising cam surfaces;

an induction coil within one of the top wall or the bottom wall, the location of the induction coil corresponding to the location of the groove;

a door rotatably hinged to the cabinet and supported for rotation between a closed position in which an inner surface of the door abuts the bottom and top walls and at least one of the first and second vertical walls to seal a portion of the chamber, and an open position providing access to a portion of the chamber;

an articulating mullion rotatably hinged to the door; and a heat pipe extending between a sealed first end and a sealed second end, the heat pipe positioned within the articulating mullion, wherein the induction coil is positioned such that the second sealed end of the heat pipe is adjacent to the induction coil when the door is in the closed position, wherein the cam surfaces interact with a tab extending from one of a top portion or a bottom portion of the mullion, the location of the tab corresponding to the location of the groove, wherein the tab comprises the sealed second end of the heat pipe and the induction coil is integrated with the groove, and wherein the heat pipe is operatively coupled to the induction coil when the door is in the closed position.

19. The refrigerator appliance of claim 18, the heat pipe further comprising:

an elongate hollow tube having the sealed first end and the sealed second end, the elongate hollow tube defining a heat pipe axis;

wherein the heat pipe axis is substantially parallel to a vertical axis of the mullion, the sealed first end proximate to a top portion of the mullion and the sealed second end proximate to a bottom portion of the mullion.

20. The refrigerator appliance of claim 19, wherein the sealed first end of the heat pipe is a condenser and the sealed second end is an evaporator.

* * * * *